US011529651B2

(12) United States Patent
Cao et al.

(10) Patent No.: US 11,529,651 B2
(45) Date of Patent: Dec. 20, 2022

(54) VIBRATION EXCITATION DEVICE AND ARC-VIBRATION TYPE TUBULAR PILE DRIVING AND PULLING MACHINE

(71) Applicant: SHANGHAI ZHENZHONG CONSTRUCTION MACHINERY TECHNOLOGY CO., LTD., Shanghai (CN)

(72) Inventors: Xiaoji Cao, Shanghai (CN); Rongxia Cao, Shanghai (CN); Peng Cao, Shanghai (CN); Moxi Cao, Shanghai (CN); Xianghua Cui, Shanghai (CN); Xiaojun Shi, Shanghai (CN)

(73) Assignee: SHANGHAI ZHENZHONG CONSTRUCTION MACHINERY TECHNOLOGY CO., LTD., Shanghai (CN)

( * ) Notice: Subject to any disclaimer, the term of this patent is extended or adjusted under 35 U.S.C. 154(b) by 74 days.

(21) Appl. No.: 17/170,071

(22) Filed: Feb. 8, 2021

(65) Prior Publication Data

US 2022/0250118 A1 Aug. 11, 2022

(51) Int. Cl.

| | |
|---|---|
| ***B06B 1/16*** | (2006.01) |
| ***E02D 7/18*** | (2006.01) |
| ***E02D 13/00*** | (2006.01) |
| ***E02D 11/00*** | (2006.01) |

(52) U.S. Cl.

CPC ..... *B06B 1/16* (2013.01); *E02D 7/18* (2013.01); *E02D 11/00* (2013.01); *E02D 13/00* (2013.01)

(58) Field of Classification Search

CPC combination set(s) only.
See application file for complete search history.

(56) References Cited

U.S. PATENT DOCUMENTS 6,142,711 A * 11/2000 Goughnour ..... E02D 7/18 74/61

FOREIGN PATENT DOCUMENTS

EP 0473449 A1 * 3/1992
KR 101178276 B1 * 8/2012

* cited by examiner

*Primary Examiner* — Kyle Armstrong
(74) *Attorney, Agent, or Firm* — CBM Patent Consulting, LLC

(57) ABSTRACT

A vibration excitation device comprises an input shaft, eccentric blocks and eccentric torque output shafts. The input shaft can drive the eccentric torque output shafts to rotate, and the eccentric blocks sleeve the outer sides of the eccentric torque output shafts. The eccentric blocks on the eccentric torque output shafts synchronously rotate along with rotation of the eccentric torque output shafts and generate a centrifugal force. The centrifugal forces of the eccentric blocks on one pair of exactly opposite eccentric torque output shafts are equal in magnitude and opposite in direction, but each pair of centrifugal forces forms a force couple. The magnitude and direction of the torque of each force couple periodically change based on the sine function rule over time, and under the action of the torques of the two pairs of force couples, the vibration excitation device generates an arc vibration in a horizontal direction.

7 Claims, 5 Drawing Sheets

VIBRATION EXCITATION DEVICE AND ARC-VIBRATION TYPE TUBULAR PILE DRIVING AND PULLING MACHINE

TECHNICAL FIELD

The present invention relates to the field of mechanical construction equipment, and more specifically to a vibration excitation device and an arc-vibration type tubular pile driving and pulling machine.

BACKGROUND

At present, in the foundation construction of buildings or structures, a vibratory hammer is widely used in foundation construction due to its numerous excellent characteristics. Its basic principle is to liquefy the soil through vibration, and reduce the side resistance and end resistance of the soil to a pile, so as to achieve the purpose of driving and pulling the pile. However, in practice, it has been found that a vibratory hammer that vibrates in the traditional up-and-down vibration mode has a large noise, and vibration waves generated by the strong vibration will also bring harms to surrounding buildings. At present, the use of vibratory hammers is restricted in many densely populated cities. Therefore, it is necessary to provide environmentally-friendly equipment that can not only play the role of vibrating liquefied soil and reducing the resistance, but also control the vibration and noise, and meet the requirements of an urban construction environment.

In the traditional vibratory pile hammer of the prior art, due to the vertical arrangement of eccentric blocks, a motor needs to overcome a gravitational moment of the eccentric block additionally while being started in addition to a moment of inertia of the eccentric blocks, which requires a large starting torque and high requirements on the motor power.

SUMMARY

An objective of the present invention is to provide a vibration excitation device and an arc-vibration type tubular pile driving and pulling machine, which can overcome the above-mentioned defect that vibration waves generated by strong vibration in the prior art will also bring harms the surrounding buildings.

The present invention adopts the following technical solutions.

A vibration excitation device comprises an input shaft, eccentric blocks and eccentric torque output shafts, wherein the input shaft can drive the eccentric torque output shafts to rotate through gear drive, and the eccentric blocks sleeve the outer sides of the eccentric torque output shafts; the eccentric blocks on the eccentric torque output shafts synchronously rotate along with rotation of the eccentric torque output shafts and generate a centrifugal force, such that the vibration excitation device generates an arc vibration in a horizontal direction.

Each eccentric block is semicircular.

The number of the eccentric torque output shafts is 4.

The centrifugal forces of the eccentric blocks, which are symmetrical with respect to the input shaft, on one pair of eccentric torque output shafts are equal in magnitude and opposite in direction, and a force couple is formed; the magnitude and direction of the torque of each force couple periodically change based on the sine function rule over time; and under the action of the torques of the two pairs of force couples, the vibration excitation device generates an arc vibration in a horizontal direction.

The vibration excitation device further comprises an outer case body.

An arc-vibration type tubular pile driving and pulling machine including the vibration excitation device is characterized by further comprising a vibration damping device.

The arc-vibration type tubular pile driving and pulling machine further comprises a hook, a pressurizing guide wheel and a clamp device, wherein the pressurizing guide wheel is fixed at the bottom of the hook; the vibration damping device is fixed at the bottom of the pressurizing guide wheel; the vibration excitation device is fixed below the vibration damping device; and the clamp device is fixed at the bottom of the vibration excitation device to clamp a pile pipe.

The present invention has the advantages: the produced vibration is a horizontal arc vibration; a pile in the present invention has no vibration impact on the ground, such that the ground vibration is greatly weakened, and horizontal vibration waves generated by the arc vibration are attenuated fast, and have less influence on surrounding buildings; and meanwhile, the motor only needs to overcome the moment of inertia of the eccentric blocks while being started, such that the power requirements for the motor are reduced, and an energy saving effect is achieved.

BRIEF DESCRIPTION OF THE DRAWINGS

The present invention will be described in detail below in conjunction with embodiments and accompanying drawings, in which.

DETAILED DESCRIPTION

The specific embodiments of the present invention are further described below.

Figure 1:
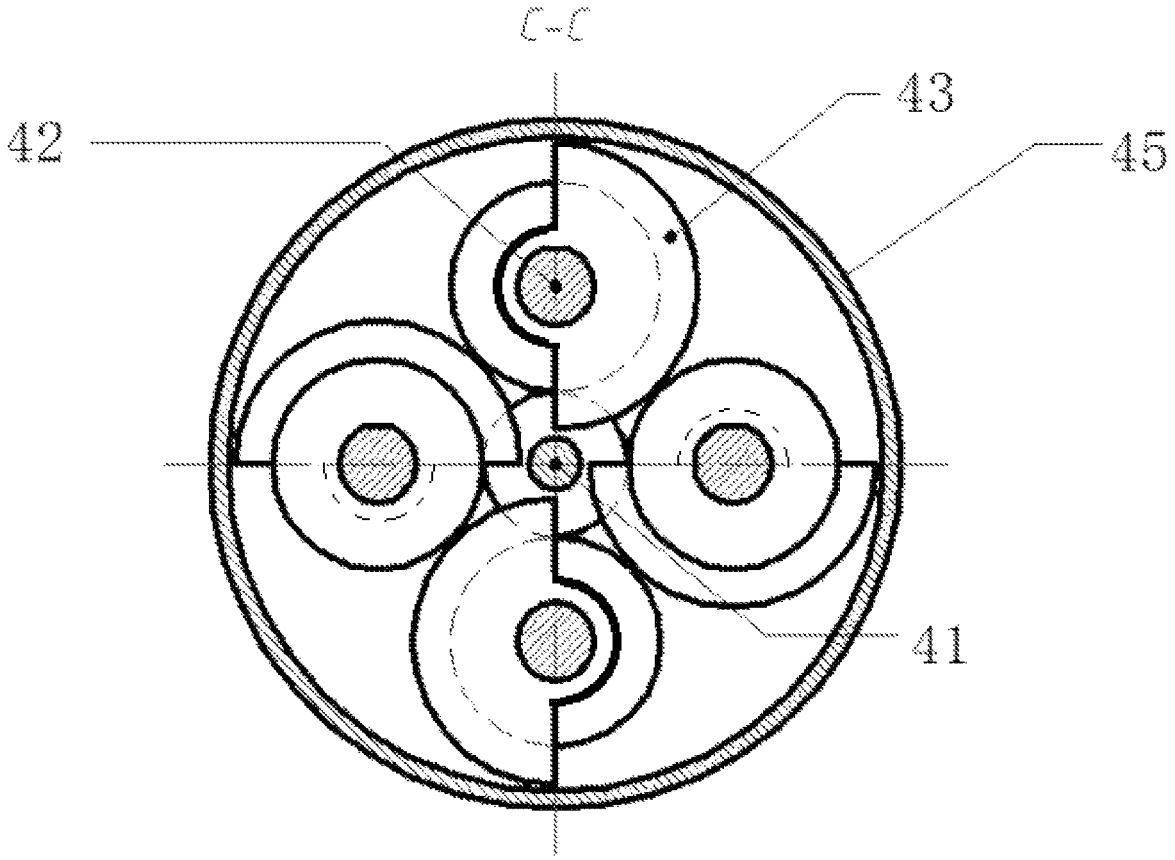
FIG. 1 is a top-view schematic diagram of the present invention.
Figure 2:
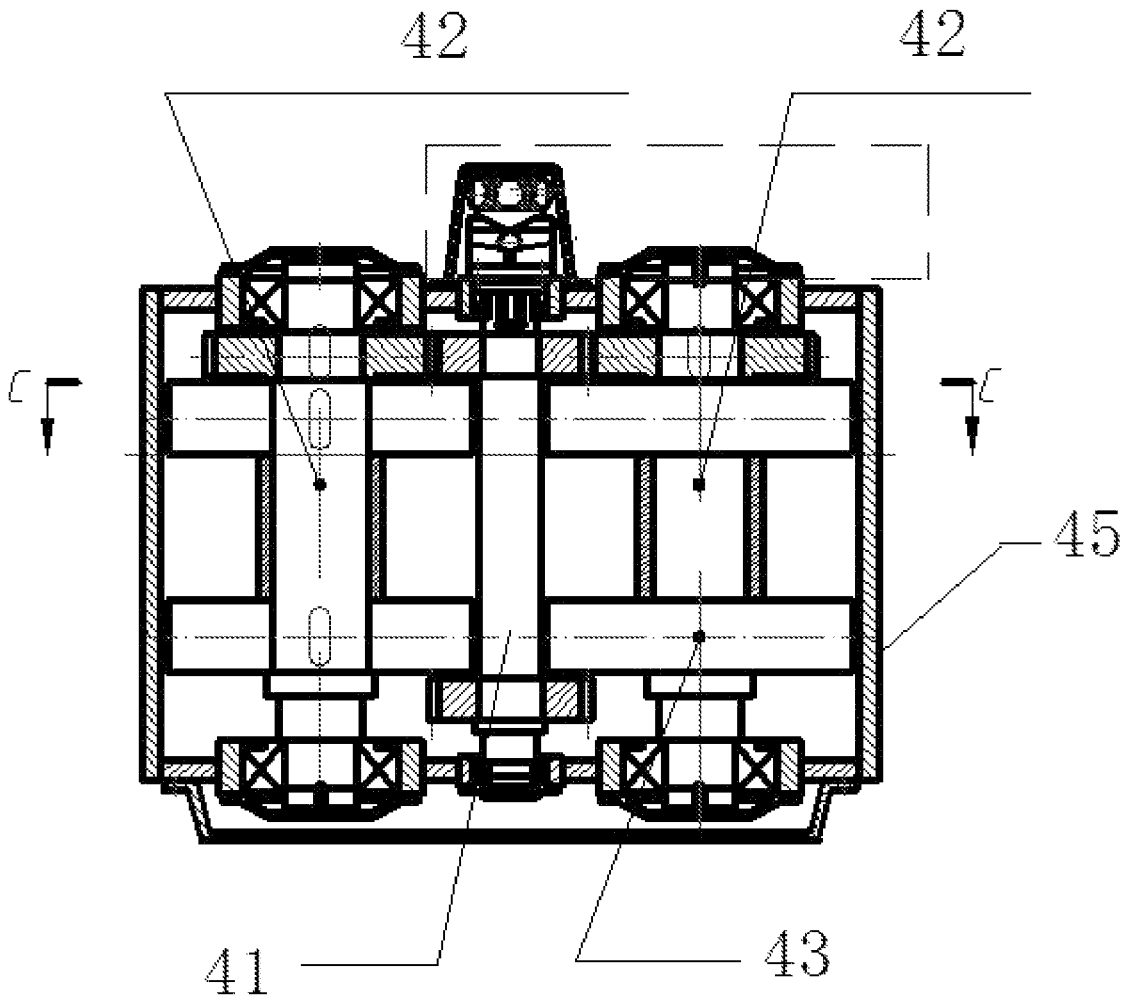
FIG. 2 is a front-view schematic diagram of the present invention.
Figure 3:
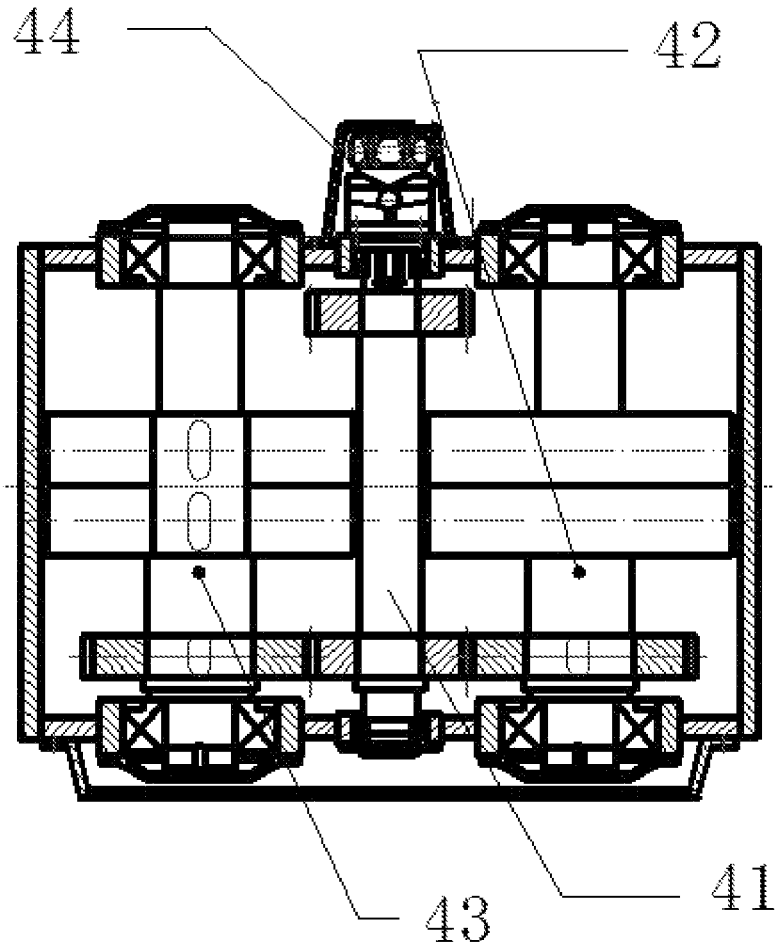
FIG. 3 is a left-view schematic diagram of the present invention.
Figure 4:
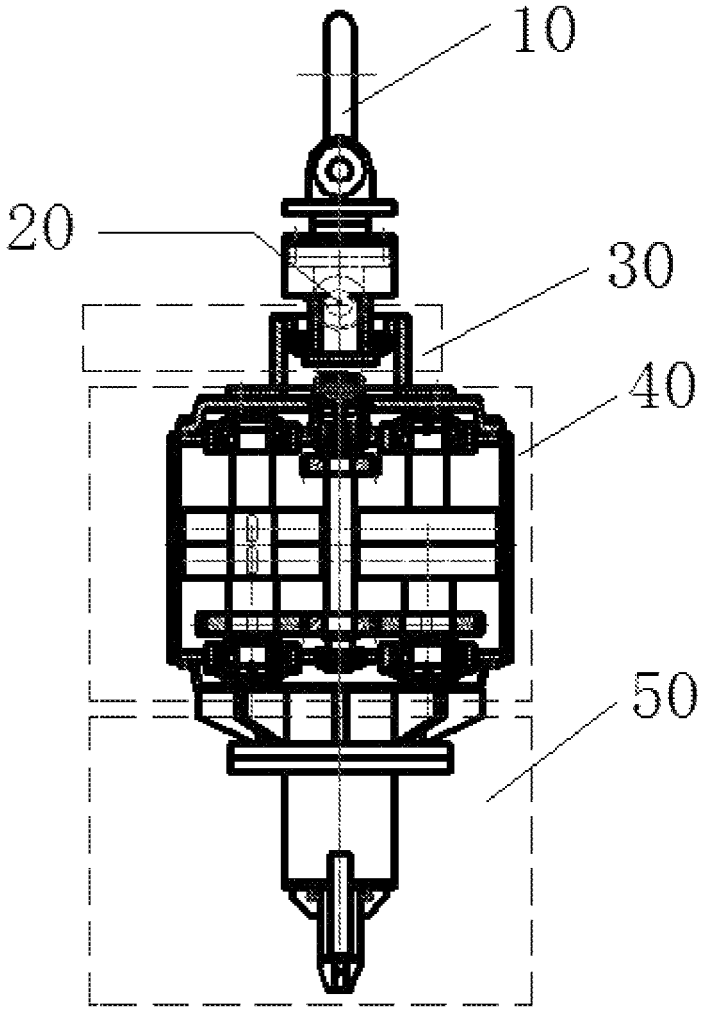
FIG. 4 is a front-view schematic diagram of an arc-vibration type tubular pile driving and pulling machine of the present invention.
Figure 5:
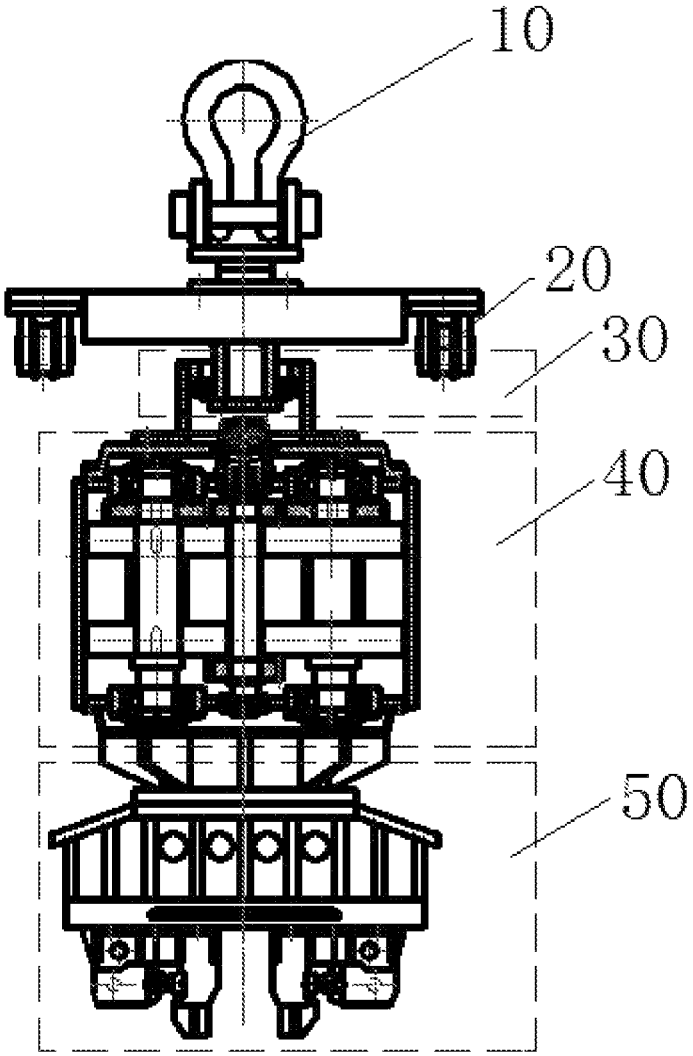
FIG. 5 is a left-view schematic diagram of the arc-vibration type tubular pile driving and pulling machine of the present invention.

As shown in FIGS. 1, 2 and 3, the present invention discloses a vibration excitation device. The vibration excitation device comprises an input shaft 41, eccentric blocks 43 and eccentric torque output shafts 42. The input shaft 41 can drive the eccentric torque output shafts 42 to rotate, and the eccentric blocks 3 sleeve the outer sides of the eccentric torque output shafts 42. The eccentric blocks on the eccentric torque output shafts synchronously rotate along with rotation of the eccentric torque output shafts and generate a centrifugal force. The centrifugal forces of the eccentric blocks on one pair of exactly opposite eccentric torque output shafts are equal in magnitude and opposite in direction, but each pair of centrifugal forces forms a force couple. The magnitude and direction of the torque of each force couple periodically change based on the sine function rule over time; and under the action of the torques of the two pairs of force couples, the vibration excitation device generates an arc vibration in a horizontal direction.

As shown in FIG. 1, each eccentric block 3 is semicircular.

In this embodiment, the number of the eccentric torque output shafts 2 is 4.

Each eccentric block is mounted on the corresponding eccentric torque output shaft.

The vibration excitation device of the present invention further comprises an outer case body 45.

The present invention further discloses an arc-vibration type tubular pile driving and pulling machine. The arc-vibration type tubular pile driving and pulling machine comprises the above-mentioned vibration excitation device, and further comprises a hook 10, a pressurizing guide wheel 20, a vibration damping device 30, a vibration excitation device 40, and a clamp device 50, wherein the pressurizing guide wheel is fixed at the bottom of the hook; the vibration damping device is fixed at the bottom of the pressurizing guide wheel; the vibration excitation device is fixed below the vibration damping device; and the clamp device is fixed at the bottom of the vibration excitation device to clamp a pile pipe.

The present invention further comprises a pressurizing device. The entire arc-vibration type tubular pile driving and pulling machine generates a downward pressure through the pressurizing device, and the pressurizing device takes effects by means of the pressurizing guide wheel 20.

The input shaft in the vibration excitation device of the present invention drives the eccentric torque output shafts to rotate. Since the eccentric blocks sleeve the outer sides of the eccentric torque output shafts, the eccentric blocks on the eccentric torque output shafts synchronously rotate along with rotation of the eccentric torque output shafts as the eccentric torque output shafts rotate, and generate a centrifugal force. The centrifugal forces of the eccentric blocks on one pair of exactly opposite eccentric torque output shafts are equal in magnitude and opposite in direction, but each pair of centrifugal forces forms a force couple. The magnitude and direction of the torque of each force couple periodically change based on the sine function rule over time; and under the action of the torques of the two pairs of force couples, the vibration excitation device generates an arc vibration in a horizontal direction, thereby driving the arc-vibration type tubular pile driving and pulling machine to produce a horizontal vibration.

In the present invention:

1. The vibration generated by the vibration excitation device of the arc-vibration type tubular pile driving and pulling machine in the present invention is a horizontal arc vibration; a pile has no vibration impact on the ground, such that the ground vibration is greatly weakened, and horizontal vibration waves generated by the arc vibration are attenuated fast, and have less influence on surrounding buildings.

2. A main body of the arc-vibration tubular pile driving and pulling machine of the present invention comprises the vibration excitation device and the vibration damping device. The placement of shafts and eccentric blocks of the traditional vibratory pile hammer is changed, i.e., the shafts are changed to be placed vertically. Since the four eccentric torque output shafts in the present invention are all driven to rotate by one input shaft, the four eccentric torque output shafts rotate at the same rotation speed and direction, and the eccentric blocks on the four shafts maintain a 90° phase difference respectively, and therefore, as the four shafts rotate synchronously, a resultant force borne by the entire vibration excitation device is zero, and the torque is a sinusoidal periodic function. Under the action of the high-frequency periodic changing moment, the vibration excitation device generates an arc vibration around the central axis, and this arc vibration causes the surrounding soil to be liquefied during construction.

3. The power for driving the input shaft to rotate in the present invention can be a motor or a hydraulic motor.

4. The arc-vibration type tubular pile driving and pulling machine of the invention meets the favorable requirements for energy conversion and environmental protection. Since the input shaft is placed vertically, the eccentric blocks rotates horizontally around the shaft and have no gravitational torque, and meanwhile, the motor only needs to overcome the moment of inertia of the eccentric blocks while being started, such that the power requirements for the motor are reduced, and an energy saving effect is achieved.

5. In the present invention, the pressurizing device can be used, and a higher construction efficiency can be achieved through pressurization during the pile driving process.

The foregoing descriptions are merely preferred embodiments of the present invention, and are not intended to limit the present invention. Within the spirit and principles of the present disclosure, any modifications, equivalent substitutions, improvements, etc., are within the protection scope of the present invention.

What is claimed is:

1. A vibration excitation device, comprising an input shaft, eccentric blocks and eccentric torque output shafts, wherein the input shaft drives the eccentric torque output shafts to rotate, and the eccentric blocks sleeve the outer sides of the eccentric torque output shafts; the eccentric blocks on the eccentric torque output shafts synchronously rotate along with rotation of the eccentric torque output shafts and generate a centrifugal force which results in an arc vibration of the vibration excitation device in a horizontal direction.

2. The vibration excitation device according to claim 1, wherein each eccentric block is semicircular.

3. The vibration excitation device according to claim 1, wherein the number of the eccentric torque output shafts is 4.

4. The vibration excitation device according to claim 3, wherein the centrifugal forces of the eccentric blocks, which are symmetrical with respect to the input shaft, on one pair of eccentric torque output shafts are equal in magnitude and opposite in direction, and a force couple is formed; the magnitude and direction of the torque of each force couple periodically change based on the sine function rule over time; and under the action of the torques of the two pairs of force couples which results in the arc vibration of the vibration excitation device in the horizontal direction.

5. The vibration excitation device according to claim 4, further comprising an outer case body.

6. An arc-vibration type tubular pile driving and pulling machine including the vibration excitation device according to claim 1, further comprising a vibration damping device.

7. The arc-vibration type tubular pile driving and pulling machine according to claim 6, further comprising a hook, a guide wheel and a clamp device, wherein the guide wheel is fixed at the bottom of the hook; the vibration damping device is fixed at the bottom of the guide wheel; the vibration excitation device is fixed below the vibration damping device; and the clamp device is fixed at the bottom of the vibration excitation device to clamp a pile pipe.

* * * * *